US012285658B2

(12) United States Patent
Shimahara

(10) Patent No.: US 12,285,658 B2
(45) Date of Patent: Apr. 29, 2025

(54) GOLF CLUB HEAD

(71) Applicant: Sumitomo Rubber Industries, Ltd., Hyogo (JP)

(72) Inventor: Yuki Shimahara, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 21 days.

(21) Appl. No.: 18/075,749

(22) Filed: Dec. 6, 2022

(65) Prior Publication Data

US 2023/0181975 A1 Jun. 15, 2023

(30) Foreign Application Priority Data

Dec. 9, 2021 (JP) ..... 2021-200326

(51) Int. Cl.
*A63B 53/10* (2015.01)
*A63B 53/04* (2015.01)

(52) U.S. Cl.
CPC ..... *A63B 53/0416* (2020.08); *A63B 53/0433* (2020.08); *A63B 53/047* (2013.01)

(58) Field of Classification Search
CPC ..... A63B 53/0454; A63B 53/0458; A63B 53/0462
See application file for complete search history.

(56) References Cited

U.S. PATENT DOCUMENTS 6,203,449 B1 * 3/2001 Kenmi ..... A63B 60/00 473/346
10,758,791 B2 * 9/2020 Norimura ..... A63B 53/047
2015/0051013 A1 2/2015 Ueda
2017/0259134 A1 * 9/2017 Ines ..... B21K 17/00

FOREIGN PATENT DOCUMENTS

JP 2015-036052 A 2/2015

* cited by examiner

*Primary Examiner* — Raeann Gorden
(74) *Attorney, Agent, or Firm* — Greenblum & Bernstein, P.L.C.

(57) ABSTRACT

A golf club head comprises a face portion having a face's front surface for hitting a ball, a face's rear surface and a face's center. The face's back surface is provided with a central thin part, a sole side thin part extending in the toe-heel direction on the sole side than the central thin part, and a sole side rib extending in the toe-heel direction located between the central thin part and the sole side thin part. The width W1 of the sole side thin part is larger than the width W2 of the sole side rib, each measured in a vertical cross-sectional view of the head taken perpendicularly to both the face's front surface and the horizontal surface, passing through the face's center.

20 Claims, 10 Drawing Sheets

Comparative example 1

Comparative example 2

Embodiemnt 1

Embodiemnt 2

Comparative example 2

Embodiemnt 1

Embodiemnt 2

GOLF CLUB HEAD

BACKGROUND OF THE INVENTION

Field of the Invention

The present disclosure relates to a golf club head.

Background Art

There have been proposed various types of golf club heads in which a central region of the face portion for striking a ball is provided with a thin part having a small thickness. (see, for example, Patent Document 1 below)

Patent Document 1: Japanese Patent Application Publication No. 2015-036052

SUMMARY OF THE INVENTION

Problems to be Solved by the Invention

In recent years, attempts have been made to widen a high repulsion area with which the hit ball flies well, by increasing the area of a thin part provided in the face portion. However, if the thin part is simply expanded toward the sole side of the face portion, a large stress is generated on the sole side of the face portion when a ball is hit, and there is a possibility that the face portion is damaged or the durability is deteriorated.

The present disclosure was made in view of the situation as described above, and a primarily objective of the present disclosure is to provide a golf club head in which a high repulsion area of the face portion can be widened, while maintaining the durability of the head.

Means for Solving the Problems

According to the present disclosure, a golf club head comprises a face portion and a sole under a reference state of the head which is placed on a horizontal surface at a lie angle and a loft angle specified for the head, wherein the face portion has a face's front surface which is a surface for hitting a ball, a face's back surface, and a face's center, and the face's back surface is provided with a central thin part, one or more sole side thin parts extending in the toe-heel direction and positioned on the sole side than the central thin part, and a sole side rib extending in the toe-heel direction and positioned between the central thin part and the sole side thin part adjacent to the central thin part, wherein in a vertical cross-sectional view of the head taken perpendicularly to both the face's front surface and the horizontal surface, passing through the face's center, a width W1 of the sole side thin part measured parallel to the face's front surface is larger than a width W2 of the sole side rib measured parallel to the face's front surface.

Effects of the Invention

In the golf club head according to the present disclosure, by adopting the above configuration, the stress on the sole side of the face portion which occurs when hitting a ball is reduced, thereby, it is possible to widen the high repulsion area of the face portion while maintaining the durability of the head.

DETAILED DESCRIPTION OF THE INVENTION

Figure 1:
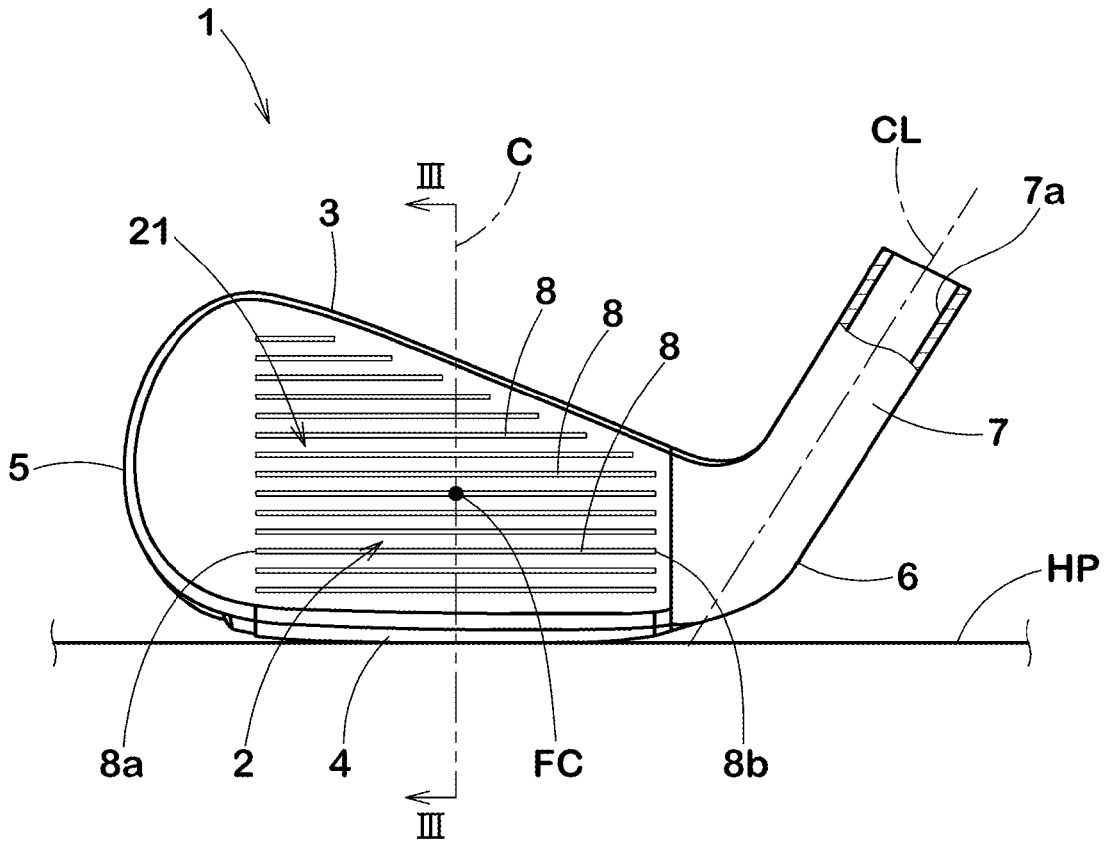
FIG. 1 is a front view of a golf club head as an embodiment of the present disclosure.

Embodiments of the present disclosure will now be described in detail in conjunction with accompanying drawings.

Throughout this specification, the same or common elements are denoted by the same reference numerals, and redundant descriptions will be omitted.

Further, the specific structures shown in the embodiments and drawings are only for understanding the present disclosure, and the present disclosure is not to be limited to the illustrated specific structures.

Figure 2:
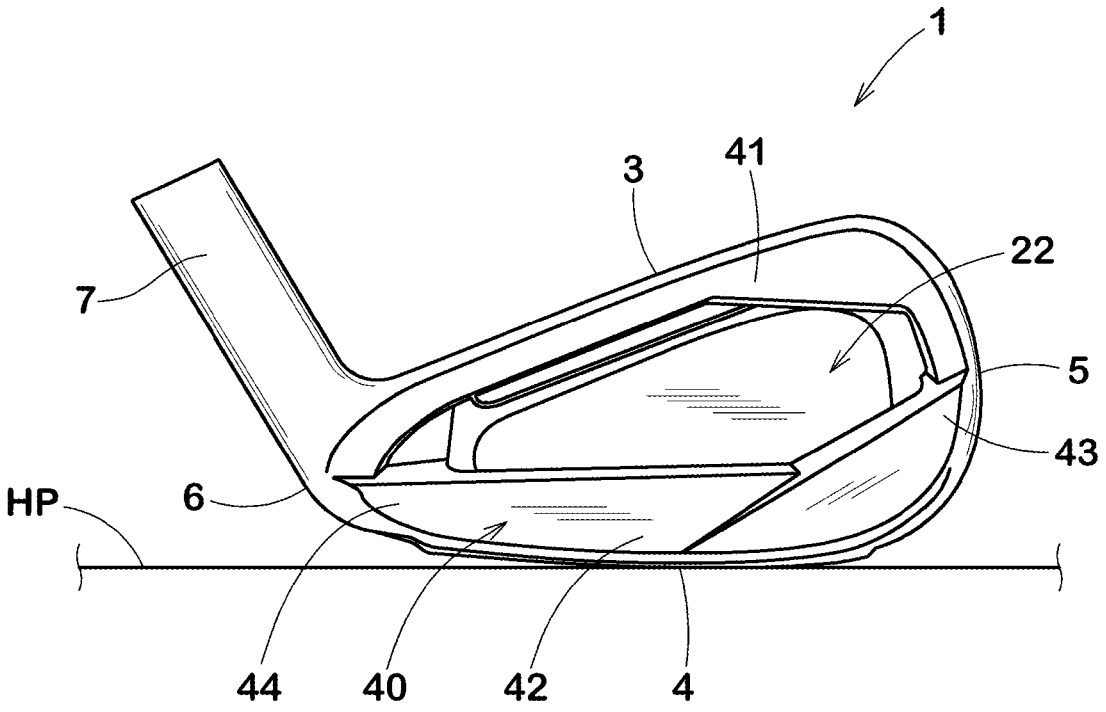
FIG. 2 is a rear view thereof.
Figure 3:
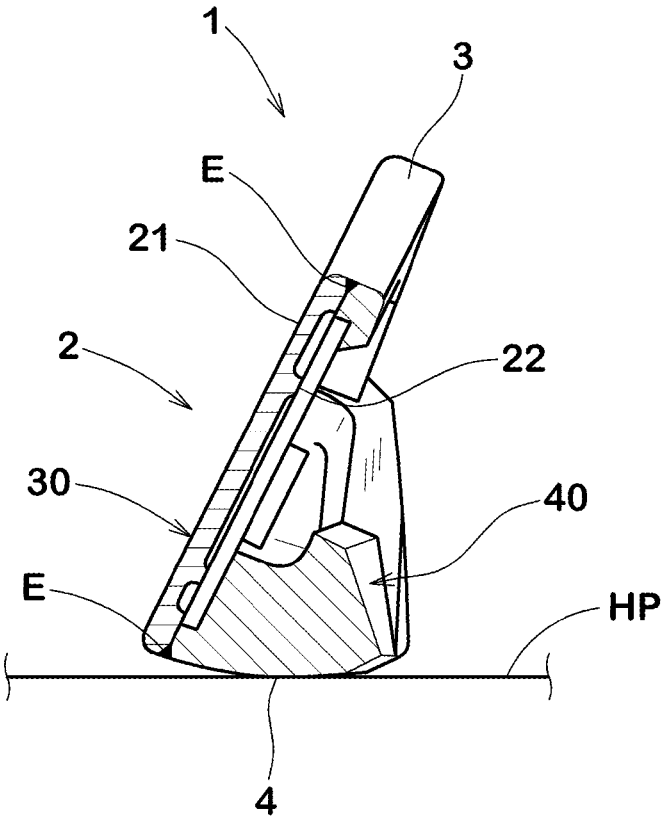
FIG. 3 is a cross-sectional view taken along line III-III of FIG. 1.

FIGS. 1 to 3 are a front view, a rear view, and a cross-sectional view taken along line III-III of FIG. 1, respectively.

The head 1 in the present embodiment is formed as an iron type head, for example, made of metal material. According to the present disclosure, however, the head may be formed as a wood type or utility type head instead of an iron type head.

In FIGS. 1 to 3, the head 1 is set in its reference state.

Figure 4:
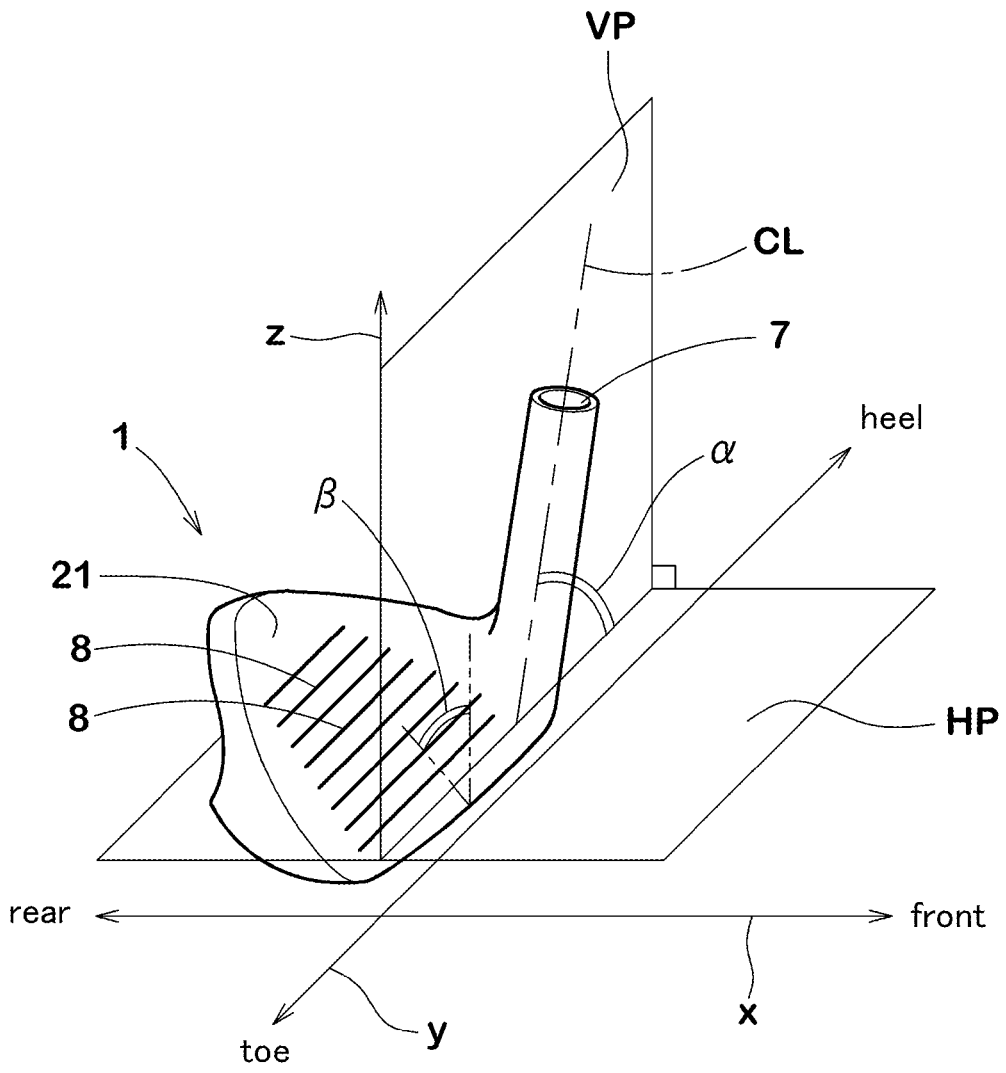
FIG. 4 is a perspective view for explaining the standard state of a golf club head.

In this specification, the "reference state" of a head means a state in which the head is placed on a horizontal surface at a lie angle $\alpha$ and loft angle $\beta$ specified for the head as shown in FIG. 4.

The lie angle $\alpha$ and loft angle $\beta$ are usually published in a product catalog or the like. In the reference state, the central axis CL of the hosel 7 of the head (which corresponds to the axis of the club shaft) is set within a reference vertical plane VP.

In the case of the reference state of an iron-type head, the head is placed on the horizontal surface HP so that face lines 8 formed in a face's front surface 21 are parallel to the horizontal surface HP.

In this application including the specification and claims, the configuration of each part is described based on the assumption that the head is placed in its reference state unless otherwise noted.

Referring to FIG. 4, the front-rear direction of the head is the direction of the x-axis orthogonal to the reference vertical plane VP.

The toe-heel direction of the head 1 is the direction of the y-axis orthogonal to the front-rear direction of the head and parallel to the horizontal surface HP.

The up-down direction of the head 1 is the direction of the z-axis orthogonal to both the x-axis and the y-axis.

The expression "front side" of the head 1 means the side of the face's front surface 21.

The expressions "rear side" and "back side" of the head 1 mean the side of a face's back surface 22.

The expressions "upper side" and "lower side" of the head 1 respectively correspond to the "upper side" and the "lower side" in the reference state.

As shown in FIGS. 1 to 3, the head 1 comprises a face portion 2.

The face portion 2 has the face's front surface 21 for hitting a ball, the face's back surface 22 on the opposite side thereto, and a face's center FC.

The face's center FC corresponds to the middle position C of the face's front surface 21 in the toe-heel direction of the head, at the middle position of the face height H1 (shown in FIGS. 6 and 7) which is the dimension of the face's front surface 21 in the up-down direction of the head as shown in FIG. 1.

Figure 5:
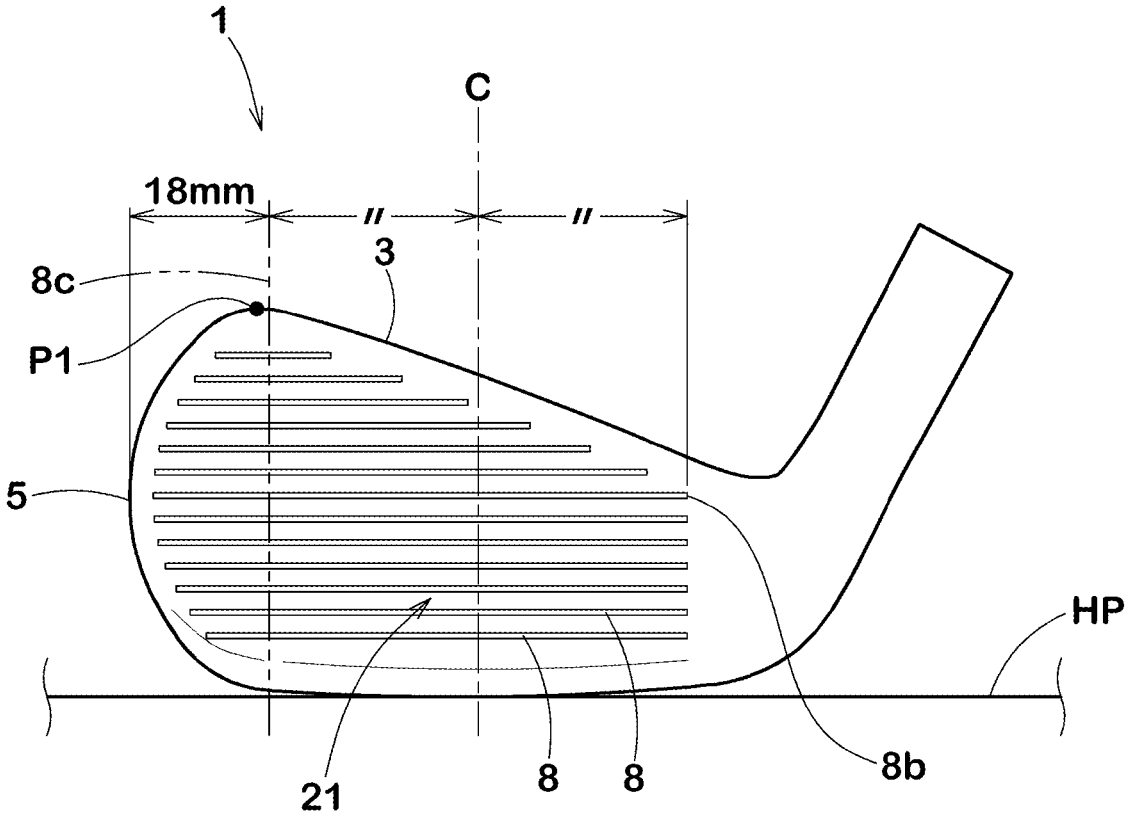
FIG. 5 is a front view of a golf club head showing a modification of the face lines shown in FIG. 1.

The middle position C of the face's front surface 21 in the toe-heel direction is, in principle, the middle position in the toe-heel direction between the most toe side end 8*a* of the face lines 8 and the most heel side end 8*b* of the face lines 8 as shown in FIG. 1. However, as shown in FIG. 5, in the case of a head 1 in which the face lines 8 extend beyond a position in the toe-heel direction corresponding to the highest point P1 of the top 3, to the vicinity of the toe 5, the middle position C of the face's front surface 21 in the toe-heel direction is the middle position between a position spaced apart 18 mm toward the heel from the most toe side edge point of the face's front surface 21, and the position of the most heel side end 8*b* of the face lines 8.

The face's front surface 21 is provided with face lines 8 for the purpose of increasing friction with the ball. The face's front surface 21 is essentially flat except for the face lines 8. Each face line 8 in the present embodiment is a narrow groove extending in parallel with the toe-heel direction of the head. The face lines 8 are formed over the intended main hitting area of the head 1 (note that the face lines 8 are omitted in some drawings).

The head 1 in the present embodiment comprises a top 3, a sole 4, a toe 5, a heel 6 and a hosel 7.

The top 3 extends rearward of the head 1 from the upper edge of the face's front surface 21, forming the upper surface of the head 1 as shown in FIG. 3.

The sole 4 extends rearward of the head 1 from the lower edge of the face's front surface 21, forming the lower surface of the head 1.

The toe 5 is an end portion farthest from the hosel 7 in the toe-heel direction, and smoothly connects the top 3 and the sole 4 as shown in FIG. 1.

The heel 6 is an end portion which is located on the opposite side of the toe 5 in the toe-heel direction of the head, and to which the hosel 7 is connected.

The hosel 7 is provided with a shaft insertion hole 7*a* into which a club shaft (not shown) is inserted and fixed as shown in FIG. 1. The central axis CL of the hosel 7 is defined by the central axis of the shaft insertion hole 7*a*.

In the present embodiment, as shown in FIG. 3, the head 1 is formed by joining a face plate 30 and a frame portion 40 for supporting the face plate 30.

The face plate 30 and the frame portion 40 can be fixed by using various techniques such as welding, screwing, caulking and/or the like.

The face plate 30 in this example has the face's front surface 21 and the face's back surface 22. This will be described later.

In the present embodiment, as shown in FIG. 2, the frame portion 40 comprises a top side frame 41, a sole side frame 42, a toe side frame 43 and a heel side frame 44.

The top side frame 41 extends in the toe-heel direction along the top 3. The sole side frame 42 extends in the toe-heel direction of the head along the sole 4. The toe side frame 43 and the heel side frame 44 are formed on the toe 5 and the heel 6, respectively, and connect between the top side frame 41 and the sole side frame 42. In the present embodiment, the frame portion 40 is formed in an annular shape so as to continuously support the outer peripheral edge portion of the face's back surface 22. Each of these frames 41, 42 and 43 has an outer peripheral surface exposed to the outer peripheral surface of the head.

In the head 1 of the present embodiment, as shown in FIG. 3, the face plate 30 is fixed onto the front surface of the frame portion 40.

In the present embodiment, the joint between the frame portion 40 and the face plate 30 is achieved by welding made from the outer peripheral surface side of the head.

The welded joint E is formed from the outer peripheral surface of the head to a depth of about 1.0 to 1.5 mm, for example, as shown in FIG. 3.

Further, in the head 1 of the present embodiment, a space extending in the up-down direction of the head, like a so-called pocket cavity, is formed between the face's rear surface 22 of the face plate 30 and the frame portion 40.

In such a cavity-back head, a large amount of weight is distributed to the periphery of the face portion, and the moment of inertia around the center of gravity of the head is increased. Therefore, in the head 1 of the present embodiment, even when the ball hits the face's front surface 21 at a position off the sweet spot, undesirable rotational motion of the face portion 2 is suppressed. This helps to stabilize the directions of the hit balls.

Figure 6:
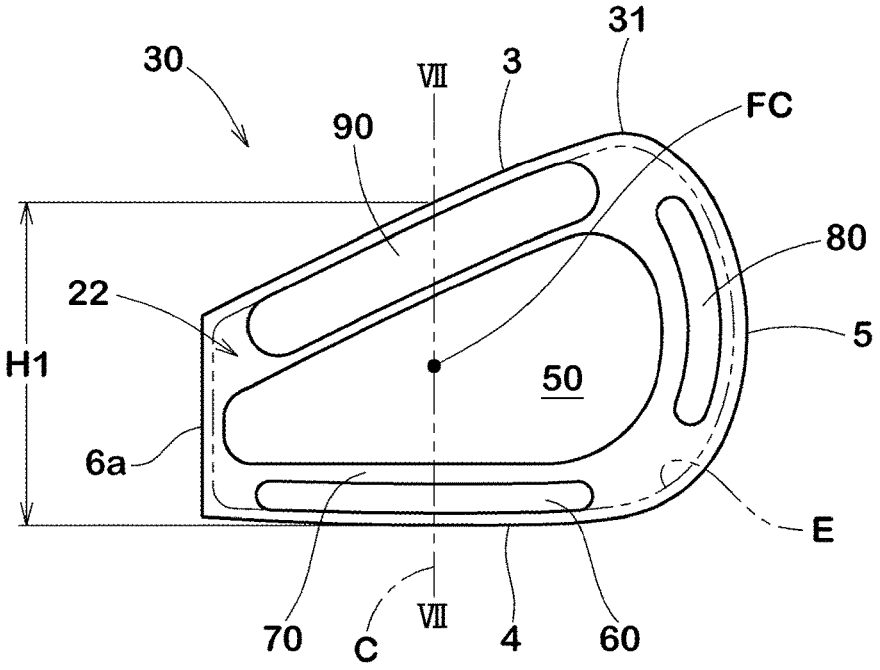
FIG. 6 is a back view of the face plate of the golf club head.
Figure 7:
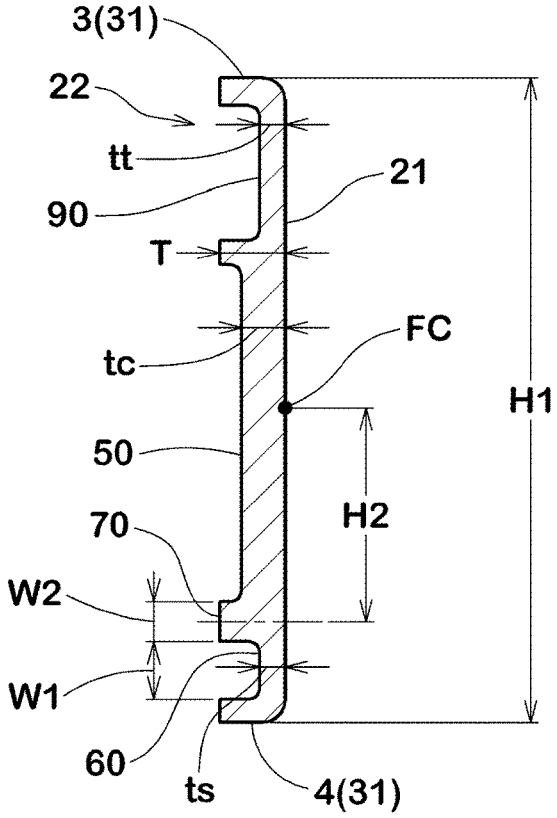
FIG. 7 is a cross-sectional view taken along line VII-VII of FIG. 6.

FIG. 6 shows a rear view of the face plate 30 before being fixed to the frame portion 40. FIG. 7 shows a cross-sectional view taken along line VII-VII of FIG. 6. As shown in FIGS. 6 and 7, the face plate 30 of the present embodiment is formed in a plate shape having a reference thickness T, and the face plate 30 has the face's front surface 21, the face's rear surface 22, and an outer peripheral surface 31 extending therebetween.

The reference thickness T means the thickness of the thickest portion of the face plate 30.

In the present embodiment, the face plate 30 has a substantially constant thickness T, except for the after-mentioned thinned portions.

From the viewpoint of maintaining the durability of the face plate 30, the reference thickness T is preferably 2.0 mm or more, more preferably 2.3 mm or more, still more preferably 2.5 mm or more, but preferably 3.0 mm or less, more preferably 2.9 mm or less, still more preferably 2.8 mm or less.

The outer peripheral surface 31 of the face plate 30 forms an anterior portion of the top 3, an anterior portion of the sole 4 and an anterior portion of the toe 5 which are exposed on the outer peripheral surface of the head.

In the present embodiment, the heel side of the outer peripheral surface 31 is formed as a heel side surface 6*a* which extends in the up-down direction of the head, while contacting with the frame portion 40, without being exposed to the outside of the head.

In FIG. 6, chain double-dashed lines indicate the deepest position of the above-mentioned welded joint E between the face plate 30 and the frame portion 40.

The face plate 30 is provided with a central thin part 50, a sole side thin part 60 and a sole side rib 70.

In the present embodiment, the central thin part 50 is formed by a concave portion formed in the face's rear surface 22. Accordingly, the thickness tc of the central thin part 50 is smaller than the reference thickness T of the face plate 30.

The central thin part 50 extends in the toe-heel direction and the up-down direction of the head, and has a contour shape, for example, similar to the contour shape of the face plate 30 formed by the outer peripheral surface 31.

In the present embodiment, the central thin part 50 occupies the largest area among the thin parts.

When the face's rear surface 22 is viewed orthogonally to the face's front surface 21, the area of the central thin part 50 is preferably 15% or more, more preferably 25% or more, but preferably 60% or less, more preferably 50% or less of the total area of the face's back surface 22.

In this view of the face's rear surface 22, the above-mentioned face's center FC is located in the central thin part 50, namely, the central thin part 50 is so positioned.

The sole side thin part 60 is formed by a concave portion formed in the face's rear surface 22. Accordingly, the thickness ts of the sole side thin part 60 is smaller than the reference thickness T of the face plate 30.

The sole side thin part 60 extends in the toe-heel direction on the sole 4 side of (below) the central thin part 50. The sole side thin parts 60 in this example has a groove shape extending in the toe-heel direction at an angle between +5 degrees and −5 degrees with respect to the toe-heel direction with a substantially constant groove width, except for both end portions in the toe-heel direction.

In the present embodiment, only one sole side thin part 60 is formed below the central thin part 50. In the present embodiment, the sole side thin part 60 extends across the middle position C in the toe-heel direction, of the face's front surface 21.

The sole side rib 70 extends in the toe-heel direction between the central thin part 50 and the sole side thin part 60.

The thickness of the sole side rib 70 is greater than the thickness tc of the central thin part 50 and the thickness ts of the sole side thin parts 60. In the present embodiment, the thickness of the sole side rib 70 is the same as the above-mentioned reference thickness T, but it may be smaller than the reference thickness T.

FIG. 7 is a vertical cross-sectional view of the face plate 30 taken perpendicularly to both the face's front surface 21 and the horizontal surface HP, passing through the face's center FC.

In FIG. 7, the width W1 of the sole side thin part 60 measured parallel to the face's front surface 21 is larger than the width W2 of the sole side rib 70 measured parallel to the face's front surface 21.

The operation of the head 1 of the present embodiment constructed as described above is as follows.

The central thin part 50 provided by the concave portion formed on the back side of the main hitting area of the face's front surface 21 and the sole side thin part 60 provided below it, allow the face plate 30 to flex greatly when hitting a ball.

Such face plate 30 can expand the high repulsion area of the face portion 2. Owing to the sole side rib 70 interposed between the central thin part 50 and the sole side thin parts 60, the impact force when hitting a ball can be moderately absorbed and then transmitted to the sole side thin part 60. Thereby, it is possible to reduce the stress acting on the sole side thin part 60 of the face plate 30 and its lower part.

Further, since the width W1 is larger than the width W2, the stress acting on the sole side of the face plate 30 is dispersed by the deformation of the sole side thin part 60, and the local stress concentration at the welded joint E is mitigated.

Furthermore, since the width W1 is relatively small, the deflection of the face plate 30 when hitting a ball is not so impaired, and deterioration of the resilience performance is suppressed.

If the width W2 of the sole side rib 70 is larger than the width W1 of the sole side thin part 60, the rigidity of the sole side rib 70 and its lower portion is excessively increased. As a result, the impact force when hitting the ball is transmitted below the sole side thin part 60 via the sole side rib 70 without being sufficiently mitigated. This is not preferable because it causes local stress concentration at the welded joint E and the like.

The width relationship W1>W2 as described above is satisfied at least in the vertical cross-section of the head shown in FIG. 7, preferably in a range between 5 mm toward the toe and 5 mm toward the heel from the vertical cross-section, more preferably 10 mm toward the toe and 10 mm toward the heel, still more preferably 15 mm toward the toe and 15 mm toward the heel.

From the standpoint of further enhancing the effect of dispersing the stress on the sole 4 side when hitting a ball and more reliably suppressing deterioration of the resilience performance, the ratio W1/W2 between the width W1 of the sole side thin part 60 and the width W2 of the sole side rib 70 is preferably 1.1 or more, more preferably 1.3 or more.

If the ratio W1/W2 is excessively large, the above-described function of the sole side rib 70 may be impaired. Therefore, the ratio W1/W2 is preferably 3.0 or less, more preferably 2.5 or less.

The width W1 of the sole side thin part 60 is preferably 3.8 mm or more, more preferably 4.1 mm or more, even more preferably 4.4 mm or more, in order to further enhance the effect of dispersing stress on the sole side when hitting a ball. The width W1 of the sole side thin part 60 is 7.5 mm or less, preferably 7.0 mm or less, more preferably 6.5 mm or less, although the width W1 is not be limited thereto.

The width W2 of the sole side rib 70 is preferably 3.5 mm or less, more preferably 3.4 mm or less, even more preferably 3.3 mm or less, in order to more reliably suppress deterioration of the resilience performance.

The width W2 of the sole side rib 70 is preferably 2.0 mm or more in order that the durability of the head 1 is not deteriorated, although the width W2 is not limited thereto.

It is preferable that the thickness ts of the sole side thin part 60 is smaller than the thickness tc of the central thin part 50. As a result, the high repulsion area of the face portion 2 can be further expanded, while maintaining the durability of the head 1 by maintaining the strength near the face's center.

The thickness ts of the sole side thin part 60 is preferably 0.9 mm or more, more preferably 1.0 mm or more, still more preferably 1.1 mm, but preferably 1.5 mm or less, more preferably 1.4 mm or less, still more preferably 1.3 mm or less, from the viewpoint of achieving both durability and high repulsion area, although the thickness ts is not to be limited thereto.

The thickness tc of the central thin part 50 is preferably 1.5 mm or more, more preferably 1.6 mm or more, still more preferably 1.7 mm or more, but preferably 2.5 mm or less, more preferably 2.4 mm or less, and even more preferably 2.3 mm or less, from the viewpoint of achieving both durability and high repulsion area, although the thickness tc is not to be limited thereto.

The ratio tc/ts between the thickness ts of the sole side thin part 60 and the thickness tc of the central thin part 50 is preferably in a range from 1.2 to 3.0. As a result, the durability of the head 1 and the effect of expanding the high repulsion area can be achieved in a well-balanced manner.

When the thickness tc of the central thin part 50 and/or the thickness ts of the sole side thin part 60 are varied within the respective thin parts, then the average thickness which is obtained by averaging the thickness by being weighted by the occupied area thereof in the thin part, is used for the above-mentioned numerical limitations.

Although the thickness tc of the central thin part 50 may be constant, it is preferable that the thickness tc decreases from the toe 5 side to the heel 6 side, for example. In the present embodiment, the thickness tc of the central thin part 50 is continuously reduced from the toe 5 side toward the heel 6 side. As a result, in the central thin part 50, the resilience performance is relatively improved on the heel 6 side.

As a rule of thumb, main hitting positions of average golfers tend to be distributed slightly more on the heel side than on the face's center FC. Therefore, by relatively enhancing the rebound performance on the heel side in the central thin part 50, it is possible to further improve the flight distance of the hit ball.

In the present embodiment, as shown in FIG. 7, in the vertical cross-sectional view of the head taken perpendicularly to both the face's front surface 21 and the horizontal surface HP, passing through the face's center FC, the ratio H2/H1 between the face height H1 measured in parallel to the face's front surface 21, and the distance H2 measured in parallel to the face's front surface 21 from the face's center FC to the center of the width W2 of the sole side rib 70, is set in a range from 0.20 to 0.41.

By setting the ratio H2/H1 in the range from 0.20 to 0.41 in this way, the above-described effects are exhibited more effectively. That is, when the ratio H2/H1 is 0.20 or more, the position of the sole side rib 70 does not come too close to the face's center FC, so the effect of widening the high repulsion area can be sufficiently exhibited.

By suppressing the ratio H2/H1 to 0.41 or less, the position of the sole side rib 70 does not come too close to the sole 4 side. As a result, stress concentration on the sole side of the face plate 30 when hitting a ball can be suppressed more reliably.

In order to expand the high repulsion area while maintaining the durability of the head 1, the ratio H2/H1 is more preferably 0.25 or more, still more preferably 0.30 or more, but more preferably 0.40 or less, still more preferably 0.39 or less.

Preferably, the sole side thin part 60 is formed within a range in the toe-heel direction where the face lines 8 are formed, namely, a range between the extreme toe side end 8*a* of the face lines 8 and the extreme heel side end 8*b* of the face lines 8.

Figure 8:
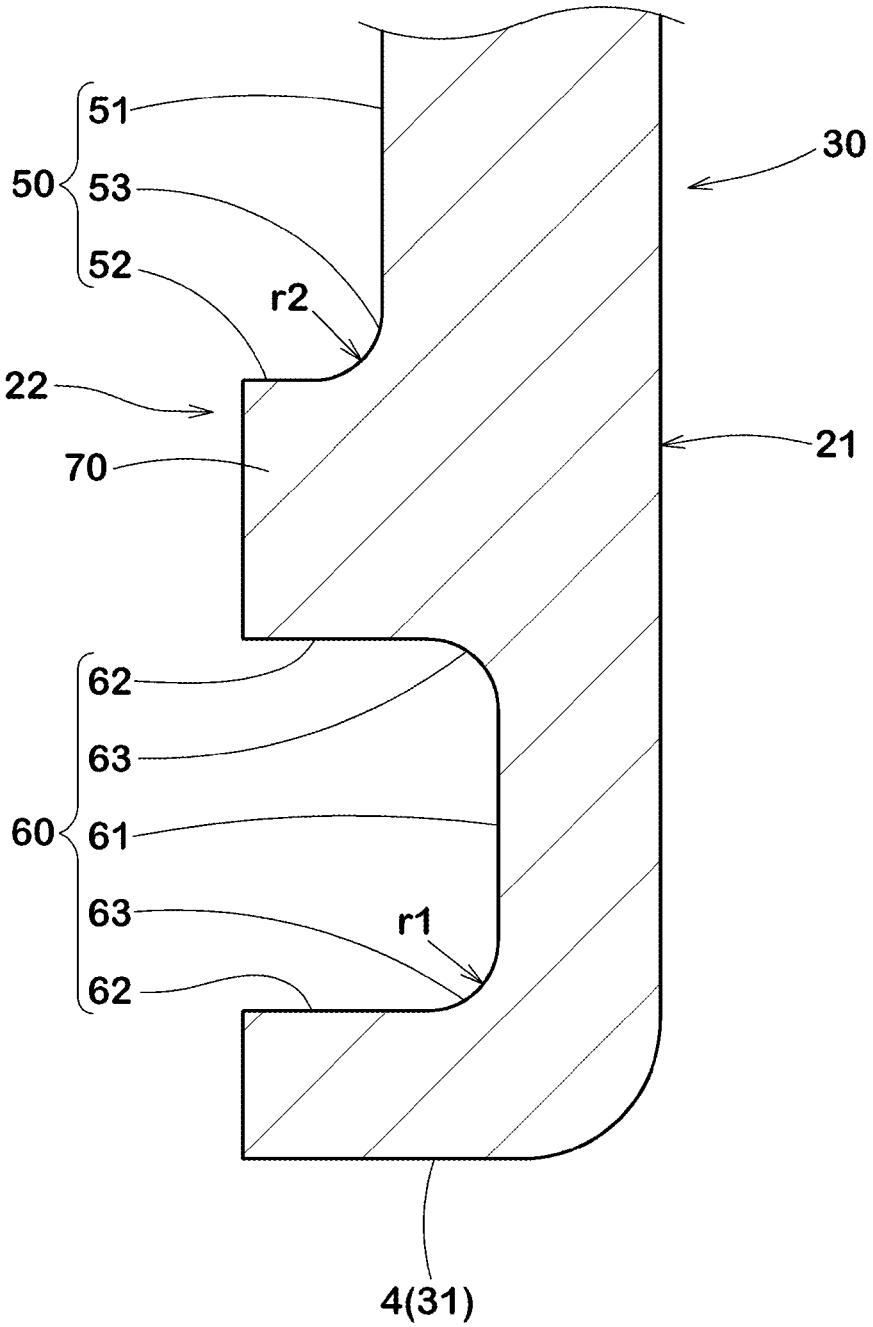
FIG. 8 is a closeup of a lower part of FIG. 7.

FIG. 8 is a closeup of a lower part of FIG. 7.

As shown, the sole side thin parts 60, which is a groove-shaped concave portion in the present embodiment as explained above, has a bottom surface 61, opposite side surfaces 62 and 62, and arc surfaces 63 and 63.

The arc surfaces 63 and 63 smoothly connect between the bottom surface 61 and the side surfaces 62 and 62.

The bottom surface 61 in this example is a surface extending substantially parallel to the face's front surface 21. Each of the side surfaces 62 is a surface extending substantially perpendicularly to the face's front surface 21.

Here, the expression "substantially" means that manufacturing errors are allowed, and specifically, errors between-5 degrees and +5 degrees with respect to the reference surface can be allowed.

Each of the arc surfaces 63 preferably has a radius r1 of curvature of 1.0 to 2.0 mm. Usually, stress tends to concentrate on the corner between the bottom surface 61 and each side surface 62 of the sole side thin part 60 when hitting a ball, but, the stress concentration on the corners of the sole-side thin portion 60 is alleviated by providing the arc surface 63 having the radius r1 of curvature as described above, and the durability of the face portion 2 is further improved.

If the radius r1 of curvature of the arc surface 63 is less than 1.0 mm, there is a possibility that the effect of alleviating the stress concentration described above cannot be sufficiently obtained. If the radius r1 of curvature of the arc surface 63 exceeds 2.0 mm, the arc surface 63 tends to suppress the bending of the sole side thin part 60, which may hinder improvement in the resilience performance.

Similarly, the central thin part 50 in the present embodiment has a bottom surface 51, side surfaces 52 surrounding the bottom surface 51, and arc surfaces 53 smoothly connecting the bottom surface 51 and the side surfaces 52.

In the present embodiment, the bottom surface 51 is formed as a surface extending substantially parallel to the face's front surface 21.

Also, each of the side surfaces 52 is formed as a surface extending substantially perpendicularly to the face's front surface 21.

Here, the expression "substantially" is used in the same sense as described above.

Preferably, each of the arc surfaces 53 has a radius r2 of curvature of 1.0 to 2.0 mm. Usually, stress tends to concentrate on the corner between the bottom surface 51 and each side surface 52 of the central thin part 50 when hitting a ball, but by providing the arc surface 53 having the radius r2 of curvature as described above, stress concentration on the corner of the central thin part 50 is alleviated, and the durability of the face portion 2 is further improved.

Returning to FIG. 6, the face plate 30 in the present embodiment further is provided, in the face's rear surface 22, with concave portions forming a toe side thin part 80 and a top side thin part 90.

The toe side thin part 80 is located on the toe side of the central thin part 50. The thickness te (not shown) of the toe side thin part 80 is smaller than the reference thickness T of the face plate 30.

Between the toe side thin part 80 and the central thin part 50, a certain space is formed.

The toe side thin part 80 extends along a toe 5 side portion of the contour of the face plate 30, and curves in an arc shape. Such toe side thin part 80 makes a toe side part of the face portion 2 easy to bend, which is helps to expand the high repulsion area toward the toe.

In the present embodiment, the thickness te of the toe side thin part 80 is smaller than the thickness tc of the central thin part 50.

When formed in this way, the high repulsion area of the face portion 2 is expanded to the toe 5 side as well, while maintaining the durability of the head 1 by reducing the stress on the toe side of the face portion 2 occurring when hitting a ball.

The top side thin part 90 is located on the top side of (above) the central thin part 50. The thickness tt of the top side thin part 90 is smaller than the reference thickness T of the face plate 30.

Between the top side thin part 90 and the central thin part 50, a certain space is formed. The top side thin part 90 extends along a top side portion of the contour of the face plate 30. Such top side thin part 90 makes the top side part of the face portion 2 more flexible, which helps to expand the high repulsion area toward the top 3.

In the present embodiment, the thickness tt of the top side thin part 90 is smaller than the thickness tc of the central thin part 50. As a result, while maintaining the durability of the head by reducing the stress generated on the top side of the face portion 2 when hitting a ball, the high repulsion area of the face portion 2 can be expanded toward the top 3.

Preferably, the thickness te of the toe side thin part 80 is smaller than the thickness tt of the top side thin part 90.

Thereby, the high repulsion area of the face portion 2 can be expanded in the toe-heel direction of the head.

In order to expand the high repulsion area in the toe-heel direction while maintaining the durability of the face portion 2, the thickness te of the toe side thin part 80 is preferably 0.6 mm or more, more preferably 0.7 mm or more, still more preferably 0.8 mm or more, but preferably 1.3 mm or less, more preferably 1.2 mm or less, still more preferably 1.1 mm or less.

In order to expand the high repulsion area in the up-down direction of the head while maintaining the durability of the face portion 2, the thickness tt of the top side thin part 90 is preferably 1.1 mm or more, more preferably 1.2 mm or more, still more preferably 1.3 mm or more, but preferably 1.8 mm or less, more preferably 1.7 mm or less, still more preferably 1.6 mm or less.

Further Embodiment

Figure 9:
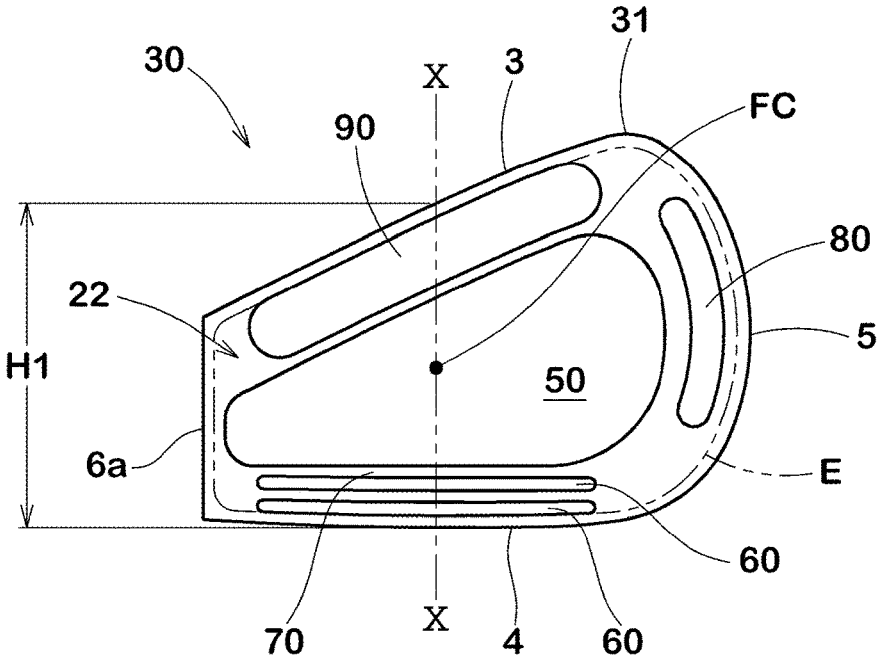
FIG. 9 is a back view of the face plate of a golf club head as another embodiment of the present disclosure.
Figure 10:
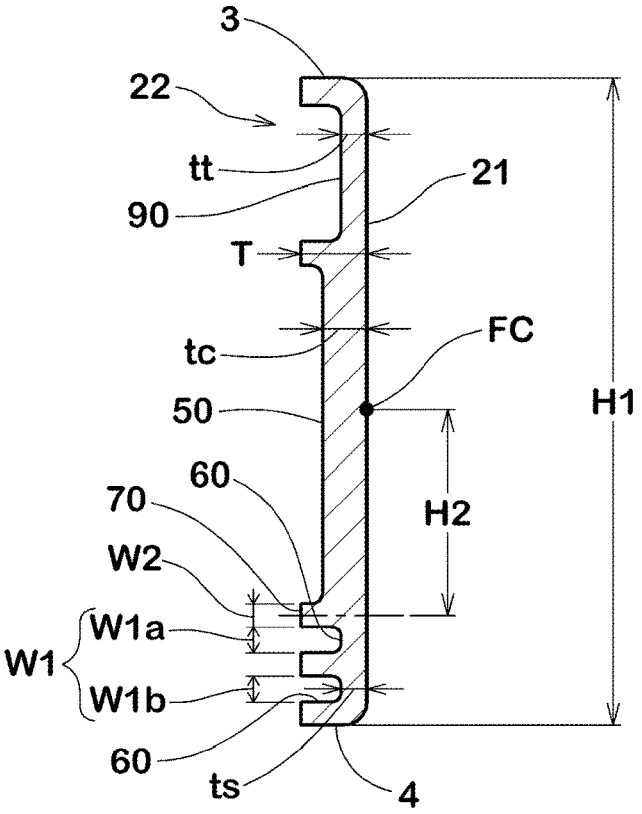
FIG. 10 is a cross-sectional view taken along line X-X of FIG. 9.
Figure 11A:
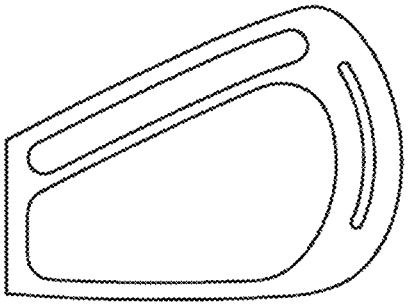
FIGS. 11A, 11B, 11C, and 11D show rear views of face plates of golf club heads of Comparative examples and Examples.
Figure 11B:
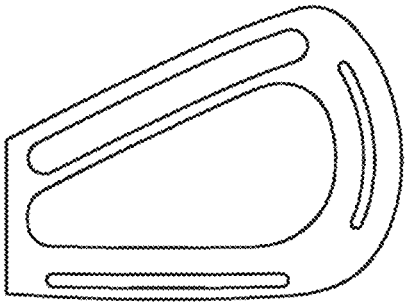
Figure 11C:
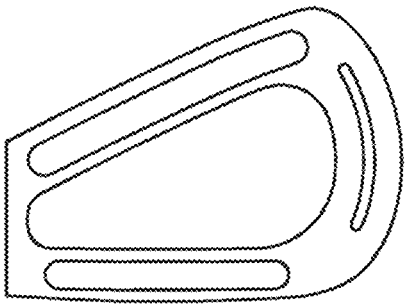
Figure 11D:
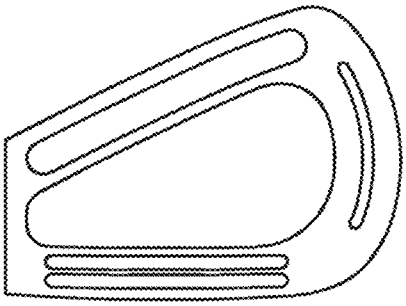

FIGS. 9 and 10 show another embodiment of the present disclosure. FIG. 9 is a back view of the face plate 30 viewed in a direction orthogonal to the face's front surface 21 to show the face's rear surface 22 thereof. FIG. 10 is a cross-sectional view taken along line X-X of FIG. 9.

As shown in FIGS. 9 and 10, the face plate 30 in this embodiment is provided with a plurality of (two in this example) sole side thin parts 60 and 60 which are spaced apart from each other in the up-down direction of the head. This is the only different from the former embodiment.

In this embodiment too, the high repulsion area of the face portion 2 can be expanded in the up-down direction of the head, while maintaining the durability of the head 1 by reducing the stress generated on the sole side of the face portion 2 when hitting a ball, as in the formed embodiment.

As to the above-mentioned numerical limitations for and using the width W1 of the sole side thin part 60 measured IN parallel to the face's front surface 21 in the former embodiment, the sum of the widths (W1*a* and W1*b*) of all the plurality of sole side thin parts (60) in the present embodiment is used as the above-mentioned width W1, and then the numerical limitations can be applied to the present embodiment.

Further, as shown in FIG. 10, the width of the sole side rib located between the central thin part 50 and the sole side thin part 60 closest thereto in the toe-heel direction (that is, the upper sole side thin part 60), is used as the above-mentioned width W2 of the sole side rib 70 in the former embodiment.

While detailed description has been made of preferable embodiments of the present invention, the present invention can be embodied in various forms without being limited to the illustrated embodiments.

Comparison Tests

More specific and non-limiting examples of the present disclosure are described below. Based on the golf club head structures shown in FIGS. 1-10, iron-type golf club heads were prepared as computer simulation models.

The specifications thereof are shown in Table 1.

In each model, in order to simulate the state of the face plate and the frame portion which were fixed by welding, the face plate and the frame portion of the model were integrated over a range of 1.5 mm from the outer peripheral surface of the face plate toward the inner side of the head.

The back sides of the face plates of the simulation models are shown in FIGS. 11A, 11B, 11C, and 11D.

Each model was then used to calculate durability and resilience performance. Durability was evaluated based on the results of impact simulations in which a ball hits the face's center of each model.

From the impact simulation, the stress at the face's center and the maximum stress generated on the sole side of the face were output.

The results are indicated by an index based on Comparative example 1 being 100, wherein the smaller value is better.

The resilience performance was evaluated by the value of the coefficient of restitution (COR). The COR value was calculated according to the "Interim Procedure for Measuring the Coefficient of Restitution of an Iron Club head Relative to a Base line Plate Revision 1.3 Jan. 1, 2006" stipulated by the United States Golf Association (USGA). In the simulation, the COR was calculated at intervals of 5 mm in the up-down direction and the toe-heel direction, over a rectangular area extending 15 mm upward from the face's center, 5 mm downward from the face's center, 15 mm toward the toe from the face's center and 15 mm toward the heel from the face's center when viewed from the front of the face's front surface 21.

Table 1 shows the specifications and the durability calculation results of the golf club head models of Examples and Comparative examples.

Figure 12A:
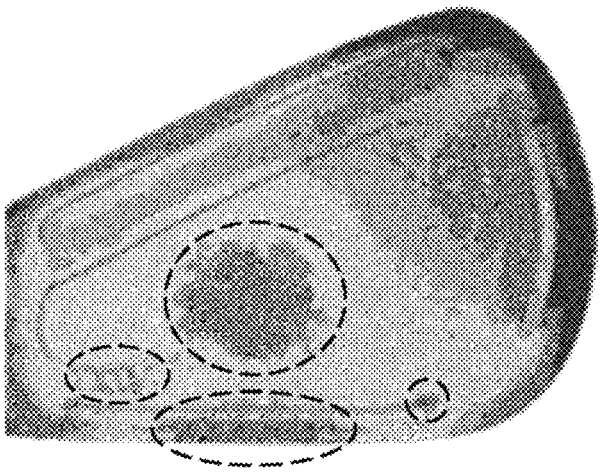
FIGS. 12A, 12B, and 12C show diagrams showing distribution of stress acting on the face plates when hitting a ball, of Comparative example 2, Example 1 and Example 2.
Figure 12B:
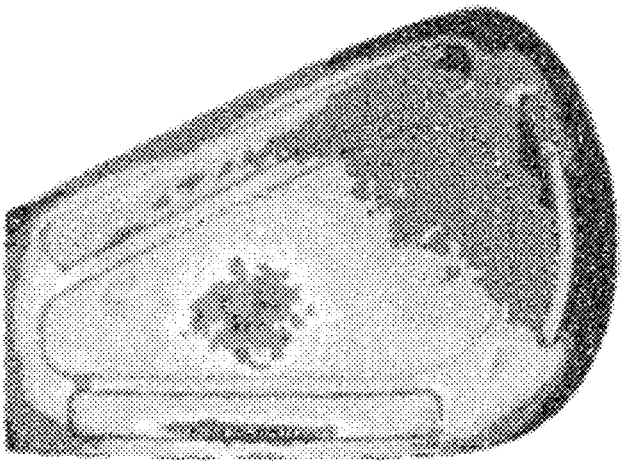
Figure 12C:
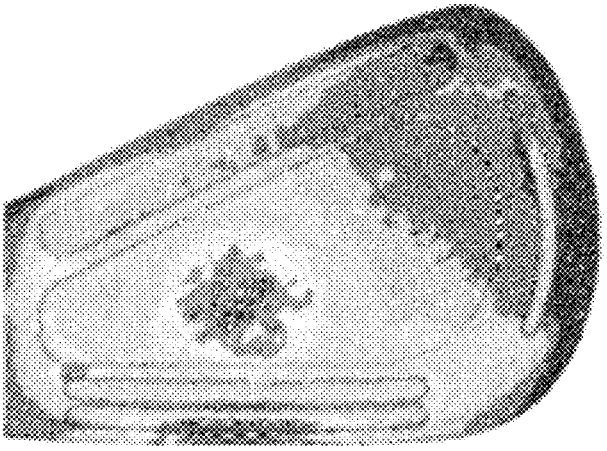

FIGS. 12A, 12B, and 12C are stress distribution diagrams of Comparative example 2, Example 1 and Example 2 as representative examples, showing the distribution of stress acting on the face plate at the moment when the maximum stress was occurred in the impact simulation.

TABLE 1

| | Comparative example 1 | Comparative example 2 | Comparative example 3 | Example 1 | Example 2 | Example 3 | Example 4 | Example 5 |
|---|---|---|---|---|---|---|---|---|
| back side of face plate (FIG. No.) | 11A | 11B | 11C | 11C | 11D | 11C | 11C | 11C |
| reference thickness T (mm) | 2.7 | 2.7 | 2.7 | 2.7 | 2.7 | 2.7 | 2.7 | 2.7 |
| face height H1(mm) | 43.0 | 43.0 | 43.0 | 43.0 | 43.0 | 43.0 | 43.0 | 43.0 |
| central thin part thickness tc (mm) | 1.90-2.30 | 1.90-2.30 | 1.90-2.30 | 1.90-2.30 | 1.90-2.30 | 1.90-2.30 | 1.90-2.30 | 1.90-2.30 |
| percentage of central thin part area to total face's back surface area | 49 | 38 | 38 | 38 | 38 | 38 | 38 | 38 |
| toe side thin part thickness te (mm) | 0.9 | 0.9 | 0.9 | 0.9 | 0.9 | 0.9 | 0.9 | 0.9 |
| top side thin part thickness tt (mm) | 1.5 | 1.5 | 1.5 | 1.5 | 1.5 | 1.5 | 1.5 | 1.5 |
| number of sole side thin part(s) | 0 | 1 | 1 | 1 | 2 | 1 | 1 | 1 |
| sole side thin part thickness ts (mm) | — | 1.2 | 1.2 | 1.2 | 1.2 | 1.2 | 1.2 | 1.2 |
| sole side thin part width W1 (mm) | — | 3.5 | 3.8 | 5.0 | 5.0 | 5.0 | 6.0 | 3.0 |
| sole-side rib width W2 (mm) | — | 5.0 | 5.0 | 3.5 | 3.5 | 4.5 | 2.0 | 1.0 |
| W1/W2 | — | 0.7 | 0.8 | 1.4 | 1.4 | 1.1 | 3.0 | 3.0 |
| distance H2 from face's center to sole side rib (mm) | — | 14.3 | 14.0 | 13.6 | 13.6 | 13.1 | 13.3 | 16.8 |
| H2/H1 | — | 0.33 | 0.33 | 0.32 | 0.32 | 0.30 | 0.31 | 0.39 |
| stress at face's center (index) | 110 | 100 | 110 | 90 | 92 | 95 | 89 | 95 |
| maximum stress on sole side of face portion (index) | 120 | 100 | 90 | 56 | 75 | 70 | 50 | 60 |

As is clear from Table 1, the stress at the face's center was reduced by about 8% or more in Example as compared to Comparative examples.

Further, with respect to the maximum stress generated on the sole side of the face portion, Example achieved a reduction effect of about 25% or more as compared to Comparative examples.

Further, in Comparative example 2 (the width of the sole side rib was larger than the width of the sole side thin part), as is clear from FIG. 12A, the color became dark over respective wide areas of the face's center, the sole-side end portion of the face plate, and the heel-side region of the sole side ribs which are surrounded by dashed lines in the figure. This indicates that high stress occurred over a wide area.

On the other hand, in Examples 1 and 2, the areas corresponding to the areas indicated by the dashed lines in Comparative example 2, showed a slightly lighter color and had a smaller area. This shows that the stress was reduced.

As to the rebound performance, Tables 2-4 show the COR distribution maps of Comparative example 2 and Examples 1 and 2 as representative examples. The horizontal axis of each map represents the distance in the toe-heel direction from the face's center, where + (plus) means the heel side and − (minus) means the toe side. The vertical axis of each map represents the distance in the up-down direction from the face's center, where + (plus) means the top side and − (minus) means the sole side. In each of Tables 2 to 4, the upper map shows the actual COR values at the respective positions, and the lower map shows the relative COR values at the respective positions which are expressed as a percentage of the maximum value of the actual COR values.

The relative COR value expressed in percentage may be referred to as COR maintenance rate (the larger value is better).

TABLE 2

| Comparative example 2 | | | | | | | |
|---|---|---|---|---|---|---|---|
| COR map Max = 0.835 | | | | | | | |
| 0.682 | 0.691 | 0.727 | 0.701 | 0.668 | 0.719 | | +15 mm |
| 0.722 | 0.780 | 0.807 | 0.816 | 0.819 | 0.775 | 0.716 | +10 mm |
| 0.754 | 0.793 | 0.831 | 0.835 | 0.829 | 0.797 | 0.760 | +5 mm |

TABLE 2-continued

| Comparative example 2 | | | | | | | |
|---|---|---|---|---|---|---|---|
| 0.763 | 0.770 | 0.782 | 0.799 | 0.805 | 0.754 | 0.755 | 0 |
| 0.664 | 0.664 | 0.724 | 0.727 | 0.685 | 0.695 | 0.677 | −5 mm |
| −15 mm | −10 mm | −5 mm | 0 | +15 mm | +10 mm | +15 mm | |
| COR maintenance rate map | | | | | | | |
| 82% | 83% | 87% | 84% | 80% | 86% | | +15 mm |
| 86% | 93% | 96% | 98% | 98% | 93% | 86% | +10 mm |
| 90% | 95% | 99% | 100% | 99% | 95% | 91% | +5 mm |
| 91% | 92% | 93% | 96% | 96% | 90% | 90% | 0 |
| 79% | 79% | 86% | 87% | 82% | 83% | 81% | −5 mm |
| −15 mm | −10 mm | −5 mm | 0 | +15 mm | +10 mm | +15 mm | |

TABLE 3

| Example 1 | | | | | | | |
|---|---|---|---|---|---|---|---|
| COR map Max = 0.835 | | | | | | | |
| 0.655 | 0.707 | 0.690 | 0.742 | 0.728 | 0.726 | | +15 mm |
| 0.725 | 0.786 | 0.807 | 0.825 | 0.800 | 0.784 | 0.721 | +10 mm |
| 0.762 | 0.794 | 0.833 | 0.831 | 0.835 | 0.805 | 0.748 | +5 mm |
| 0.729 | 0.777 | 0.798 | 0.823 | 0.812 | 0.764 | 0.697 | 0 |
| 0.702 | 0.688 | 0.713 | 0.718 | 0.688 | 0.680 | 0.701 | −5 mm |
| −15 mm | −10 mm | −5 mm | 0 | +15 mm | +10 mm | +15 mm | |
| COR maintenance rate map | | | | | | | |
| 78% | 84% | 82% | 88% | 87% | 86% | | +15 mm |
| 86% | 94% | 96% | 98% | 95% | 93% | 86% | +10 mm |
| 91% | 95% | 99% | 99% | 99% | 96% | 89% | +5 mm |
| 87% | 93% | 95% | 98% | 97% | 91% | 83% | 0 |
| 84% | 82% | 85% | 85% | 82% | 81% | 83% | −5 mm |
| −15 mm | −10 mm | −5 mm | 0 | +15 mm | +10 mm | +15 mm | |

TABLE 4

| Example 2 | | | | | | | |
|---|---|---|---|---|---|---|---|
| COR map Max = 0.842 | | | | | | | |
| 0.680 | 0.726 | 0.728 | 0.753 | 0.736 | 0.720 | | +15 mm |
| 0.757 | 0.796 | 0.822 | 0.836 | 0.821 | 0.794 | 0.759 | +10 mm |
| 0.771 | 0.812 | 0.842 | 0.838 | 0.840 | 0.805 | 0.726 | +5 mm |
| 0.747 | 0.795 | 0.798 | 0.784 | 0.788 | 0.781 | 0.752 | 0 |
| 0.736 | 0.714 | 0.736 | 0.707 | 0.752 | 0.728 | 0.745 | −5 mm |
| −15 mm | −10 mm | −5 mm | 0 | +15 mm | +10 mm | +15 mm | |

TABLE 4-continued

| Example 2 | | | | | | | |
|---|---|---|---|---|---|---|---|
| COR maintenance rate map | | | | | | | |
| 80% | 85% | 86% | 89% | 87% | 85% | | +15 mm |
| 89% | 94% | 97% | 98% | 97% | 93% | 89% | +10 mm |
| 91% | 96% | 99% | 99% | 99% | 95% | 85% | +5 mm |
| 88% | 94% | 94% | 92% | 93% | 92% | 89% | 0 |
| 87% | 84% | 87% | 83% | 88% | 86% | 88% | −5 mm |
| −15 mm | −10 mm | −5 mm | 0 | +15 mm | +10 mm | +15 mm | |

As is clear from Tables 2 to 4, it was confirmed that the high resilience area was expanded in Examples. Specific considerations are given below.

First, attention is paid to the COR maintenance rate in the area ranging 5 mm above and below from the face's center and 10 mm toward the toe and heel from the face's center, which is the area where the probability of hitting a ball is high when hitting a ball directly placed on the ground:

in Comparative example, the average value of the COR maintenance rate in this area was 91.5%, but in Examples 1 and 2, such average values were 91.8% and 91.9%, respectively, which are higher than that of Comparative example; and in Examples 1 and 2, the difference between the maximum value and the minimum value of the COR maintenance rate occurred in this area is smaller than that of Comparative example by at least 2 points.

Assuming that the launch angle of the hit ball and the ball spin are the same, and the flight distance of the hit ball is directly related to the rebound performance, it is estimated that the variation in the flight distances in Examples 1 and 2 are improved by 3 yards or more as compared to Comparative example.

Further, focusing on the area ranging 5 mm from the face's center, which is the area where advanced golfers have a high probability of hitting a ball, the COR maintenance rate of Example 1 is 97.9%. Thus, it is believed that Example 1 shows a more significant performance difference as compared to Comparative example.

Statement of the Present Disclosure

The Present Disclosure is as Follows:—

Disclosure 1: A golf club head comprising a face portion and a sole under a reference state of the head which is placed on a horizontal surface at a lie angle and a loft angle specified for the head, wherein the face portion has a face's front surface which is a surface for hitting a ball, a face's back surface, and a face's center, and the face's back surface is provided with a central thin part, at least one sole side thin part extending in the toe-heel direction and positioned on the sole side than the central thin part, and a sole side rib extending in the toe-heel direction and positioned between the central thin part and the sole side thin part adjacent to the central thin part, wherein in a vertical cross-sectional view of the head taken perpendicularly to both the face's front surface and the horizontal surface, passing through the face's center, a width W1 of the sole side thin part measured parallel to the face's front surface is larger than a width W2 of the sole side rib measured parallel to the face's front surface.

Disclosure 2: The golf club head according to Disclosure 1, wherein the ratio W1/W2 of the width W1 and the width W2 is 1.1 or more.

Disclosure 3: The golf club head according to Disclosure 1, wherein the width W1 of the sole side thin part is 3.8 mm or more.

Disclosure 4: The golf club head according to Disclosure 1, wherein the width W2 of the sole side rib is 3.5 mm or less.

Disclosure 5: The golf club head according to Disclosure 1, wherein the thickness of the sole side thin part is smaller than the thickness of the central thin part.

Disclosure 6: The golf club head according to any one of Disclosures 1 to 5, wherein in the vertical cross-sectional view of the head, the ratio H2/H1 between a face height H1 of the face's front surface measured in parallel to the face's front surface, and a distance H2 measured in parallel to the face's front surface from the face's center to the center of the width W2 of the sole side rib, is in a range from 0.20 to 0.41.

Disclosure 7: The golf club head according to any one of Disclosures 1-6, wherein the face's front surface is provided with face lines extending in the toe-heel direction, and the sole side thin part is formed within a range in the toe-heel direction where the face lines are formed.

Disclosure 8: The golf club head according to any one of Disclosures 1 to 7, wherein the thickness of the central thin part decreases from the toe side to the heel side of the central thin part.

Disclosure 9: The golf club head according to any one of Disclosures 1 to 8, wherein the sole side thin part has a bottom surface, side surfaces and arc surfaces smoothly connecting the bottom surface and the side surfaces, and the arc surfaces each have a radius of curvature of 1.0 to 2.0 mm.

Disclosure 10: The golf club head according to any one of Disclosures 1 to 9, wherein the thickness of the central thin part is 1.5 to 2.5 mm, the thickness of the sole side thin part is 0.9 to 1.5 mm, and the thickness of the sole side rib is 2.0 to 3.0 mm.

Disclosure 11: The golf club head according to any one of Disclosures 1-10, which is an iron type golf club head for an iron golf club.

DESCRIPTION OF THE REFERENCE SIGNS

1 golf club head
2 face portion
4 sole
5 toe
6 heel
8 face line
21 face's front surface
22 face's rear surface
50 central thin part
51 bottom surface
52 side surface
53 arc surface
60 sole side thin part
61 bottom surface
62 side surface
63 arc surface
70 sole side rib
FC face's center
HP horizontal surface

The invention claimed is:

1. A golf club head comprising a face portion and a sole, wherein the face portion has a face's front surface which is a surface for hitting a ball, a face's back surface, and a face's center; and the face's back surface is provided with a part defining a central thin part of the face portion, a part defining a sole side rib part of the face portion extending in a toe-heel direction and positioned on the sole side of the central thin part, and a part defining a sole side thin part of the face portion extending in the toe-heel direction and positioned on the sole side of the sole side rib part;

wherein in a vertical cross-sectional view of the head passing through the face's center, a thickness of the central thin part is smaller than a thickness of the sole side rib part, a thickness of the sole side thin part is smaller than the thickness of the sole side rib part, and a width W1 of the sole side thin part measured parallel to the face's front surface is larger than a width W2 of the sole side rib part measured parallel to the face's front surface.

2. The golf club head according to claim 1, wherein the ratio W1/W2 of the width W1 and the width W2 is 1.1 or more.

3. The golf club head according to claim 1, wherein the width W1 of the sole side thin part is 3.8 mm or more.

4. The golf club head according to claim 1, wherein the width W2 of the sole side rib part is 3.5 mm or less.

5. The golf club head according to claim 1, wherein the thickness of the sole side thin part is smaller than the thickness of the central thin part.

6. The golf club head according to claim 1, wherein in the vertical cross-sectional view of the head, the ratio H2/H1 between a face height H1 of the face's front surface measured in parallel to the face's front surface, and a distance H2 measured in parallel to the face's front surface from the face's center to the center of the width W2 of the sole side rib part, is in a range from 0.20 to 0.41.

7. The golf club head according to claim 1, wherein the face's front surface is provided with face lines extending in the toe-heel direction, and the sole side thin part is formed within a range in the toe-heel direction where the face lines are formed.

8. The golf club head according to claim 1, wherein the thickness of the central thin part decreases from the toe side to the heel side of the central thin part.

9. The golf club head according to claim 1, wherein the sole side thin part has a bottom surface, side surfaces and arc surfaces smoothly connecting the bottom surface and the side surfaces, and the arc surfaces each have a radius of curvature of 1.0 to 2.0 mm in the vertical cross-sectional view of the head.

10. The golf club head according to claim 1, wherein the thickness of the central thin part is 1.5 to 2.5 mm, the thickness of the sole side thin part is 0.9 to 1.5 mm, and the thickness of the sole side rib part is 2.0 to 3.0 mm.

11. The golf club head according to claim 1, which is an iron type golf club head for an iron golf club.

12. A golf club head comprising a face portion and a sole, wherein the face portion has a face's front surface which is a surface for hitting a ball, a face's back surface, and a face's center; and the face's back surface is provided with a part defining a central thin part of the face portion, a part defining a first sole side rib part of the face portion extending in a toe-heel direction and positioned on the sole side of the central thin part, and parts defining a plurality of sole side thin parts of the face portion extending in the toe-heel direction and positioned on the sole side of the first sole side rib part, the sole side thin parts arranged in an up-down direction of the head with an additional sole side rib part in between, wherein in a vertical cross-sectional view of the head passing through the face's center, a thickness of the central thin part is smaller than a thickness of the first sole side rib part, a thickness of each of the sole side thin parts is smaller than the thickness of the first sole side rib part, and a total width W1 of the plurality of sole side thin parts measured parallel to the face's front surface is larger than a width W2 of the first sole side rib part measured parallel to the face's front surface.

13. The golf club head according to claim 12, wherein the ratio W1/W2 of the total width W1 and the width W2 is 1.1 or more.

14. The golf club head according to claim 12, wherein the total width W1 of the sole side thin parts is 3.8 mm or more.

15. The golf club head according to claim 12, wherein the width W2 of the first sole side rib is 3.5 mm or less.

16. The golf club head according to claim 12, wherein the thickness of each sole side thin part is smaller than the thickness of the central thin part.

17. The golf club head according to claim 12, wherein in the vertical cross-sectional view of the head, the ratio H2/H1 between a face height H1 of the face's front surface measured in parallel to the face's front surface, and a distance H2 measured in parallel to the face's front surface from the face's center to the center of the width W2 of the first sole side rib part, is in a range from 0.20 to 0.41.

18. The golf club head according to claim 12, wherein the face's front surface is provided with face lines extending in the toe-heel direction, and the sole side thin parts are formed within a range in the toe-heel direction where the face lines are formed.

19. The golf club head according to claim 12, wherein the thickness of the central thin part decreases from the toe side to the heel side of the central thin part.

20. The golf club head according to claim 12, wherein each sole side thin part has a bottom surface, side surfaces and arc surfaces smoothly connecting the bottom surface and the side surfaces, and the arc surfaces each have a radius of curvature of 1.0 to 2.0 mm in the vertical cross-sectional view of the head.

* * * * *